US006232930B1

(12) United States Patent
Faulkner

(10) Patent No.: US 6,232,930 B1
(45) Date of Patent: May 15, 2001

(54) DUAL BAND ANTENNA AND METHOD OF MAKING SAME

(75) Inventor: Scott Anthony Faulkner, Harrisburg, PA (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/206,445

(22) Filed: Dec. 7, 1998

Related U.S. Application Data

(60) Provisional application No. 60/069,980, filed on Dec. 18, 1997.

(51) Int. Cl.[7] ..... H01Q 1/36
(52) U.S. Cl. ..... 343/895; 343/749
(58) Field of Search ..... 343/895, 749, 343/750; H01Q 1/36

(56) References Cited

U.S. PATENT DOCUMENTS

| | | | | |
|---|---|---|---|---|
| 4,080,604 | * | 3/1978 | Wosniewski | 343/750 |
| 4,356,492 | | 10/1982 | Kaloi | 343/700 MS |
| 4,460,896 | * | 7/1984 | Shmitka | 343/750 |
| 4,730,195 | | 3/1988 | Phillips et al. | 343/792 |
| 4,800,392 | | 1/1989 | Garay et al. | 343/700 MS |
| 4,843,404 | | 6/1989 | Benge et al. | 343/895 |
| 4,849,765 | | 7/1989 | Marko | 343/702 |
| 4,860,020 | | 8/1989 | Wong et al. | 343/828 |
| 5,075,691 | | 12/1991 | Garay et al. | 343/830 |
| 5,231,412 | | 7/1993 | Eberhardt et al. | 343/790 |
| 5,241,299 | | 8/1993 | Appalucci et al. | 340/572 |
| 5,412,392 | | 5/1995 | Tsunekawa | 343/702 |
| 5,504,494 | | 4/1996 | Chatzipetros et al. | 343/702 |
| 5,649,350 | | 7/1997 | Lampe et al. | 29/600 |
| 5,717,409 | | 2/1998 | Garner et al. | 343/702 |
| 5,724,717 | | 3/1998 | Gherardini et al. | 29/600 |
| 5,812,097 | | 9/1998 | Maldonado | 343/790 |
| 5,841,407 | | 11/1998 | Birnbaum | 343/895 |
| 5,923,305 | | 7/1999 | Sadler et al. | 343/895 |

FOREIGN PATENT DOCUMENTS

| | | | |
|---|---|---|---|
| 0590534 B1 | 4/1994 | (EP) | H01Q/1/24 |
| 0825672 A2 | 2/1998 | (EP) | H01Q/5/00 |
| 2148 604 | 5/1985 | (GB) | H01Q/9/30 |
| WO 94/28595 | 12/1994 | (WO) | H01Q/19/09 |
| WO 96/38882 | 12/1996 | (WO) | H01Q/9/30 |
| WO 98/10485 | 3/1998 | (WO) | H01Q/5/00 |

* cited by examiner

*Primary Examiner*—Michael C. Wimer

(57) ABSTRACT

A dual band antenna (12) includes a coil (14) and a reactive element (30). The coil (14) has a plurality of windings (20) including first and second selected windings (22,24) between the first and second ends (16,18). Reactive element (30) includes a conductive element (32) disposed on a dielectric film (40), the conductive element (32) having a selected area and shape and extending to first and second ends (34,36) associated with the first and second selected windings (22,24). The reactive element (30) is at least partially wrapped around the coil (14) with the film (40) adjacent to the windings (20) and extending therealong at least between the first and second selected windings (22,24) such that the first and second ends (34,36) of the conductive element (32) are adjacent to and insulated from the first and second selected windings (22,24).

14 Claims, 3 Drawing Sheets

DUAL BAND ANTENNA AND METHOD OF MAKING SAME

This application claims benefit to provisional application 60/069,980 filed Dec. 18, 1997.

FIELD OF THE INVENTION

This invention is directed to antennas and more particularly to dual band antennae.

BACKGROUND OF THE INVENTION

The cellular communications industry including cellular telephones and the like use a range of frequencies between 800 and 900 megahertz (MHz). Cellular telephones, pagers, and the like generally use a whip or stub antenna that is tuned to provide optimum performance in the above frequency range. With the advent of personal communications services (PCS) for providing services such as data transmission, wireless voice mail, and the like, the Federal Communications Commission (FCC) has established a center frequency of 1.92 gigahertz (GHz) with a suitable band width, well known to one skilled in the art. As the new PCS technology expands, there is a need to provide devices that can receive and transmit communications in both the 800–900 MHz and 1.85 to 1.99 GHz frequency ranges. Cellular telephones and the like, therefore, need to have antennae that will operate at each of the two frequency ranges. One way to achieve this is to provide two separate antennae. It is more desirable and economical, however, to provide a single antenna having at least dual band capability.

SUMMARY OF THE INVENTION

This invention is directed to a dual band antenna including first and second members. The first member defines a coil having first and second ends and a plurality of windings including first and second selected windings between the ends, the first end being a feed point. The second member defines a reactive element having a conductive element disposed on a first surface of a dielectric film. The conductive element has a selected area and shape and extends to first and second ends associated with the first and second selected windings. The second member is at least partially wrapped around the coil with a second surface of the film adjacent to the windings and extending therealong at least between the first and second selected windings such that the first and second ends of the conductive element are adjacent to the first and second selected windings. The dielectric layer extends between the conductive element and the windings. At high frequencies, the second member forms a short circuit between the first and second selected windings and at low frequencies the second element is essentially electrically inactive.

The antenna can be tuned to desired frequencies by adjusting the dimensions and locations of the various components of the assembly. Such a dual band antenna may be utilized for both coaxial and non-coaxial connections with a cellular phone or the like.

An embodiment of the invention will now be described by way of example with reference to the accompanying drawings.

DETAILED DESCRIPTION OF THE EMBODIMENT

Figure 1:
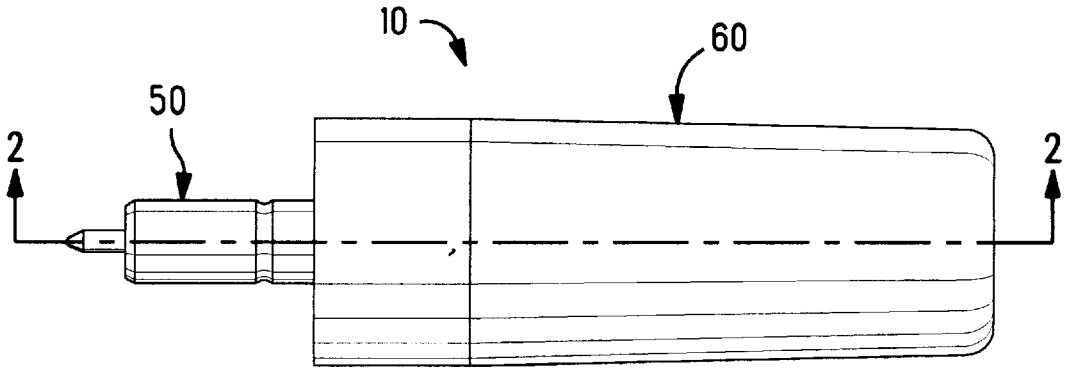
FIG. 1 is an assembled view of an antenna made in accordance with the present invention.

For purposes of illustration, the present invention will be described in terms of a dual band antenna for a cellular telephone. The antenna is also suitable for use with paging devices, two-way hand-held and base unit communication devices, computer networking systems, transponders and other like devices.

Referring now to FIGS. 1 through 5, dual band antenna assembly 10 includes an antenna 12 disposed in a dielectric sleeve 60 and electrically connected to a coaxial connector 50. It is to be understood that other ways, as known in the art, may also be used to mount the antenna to an electrical article and to provide electrical connection therebetween; for example, a non-coaxial connector is utilized in the embodiment of FIGS. 7 and 8.

Figure 2:
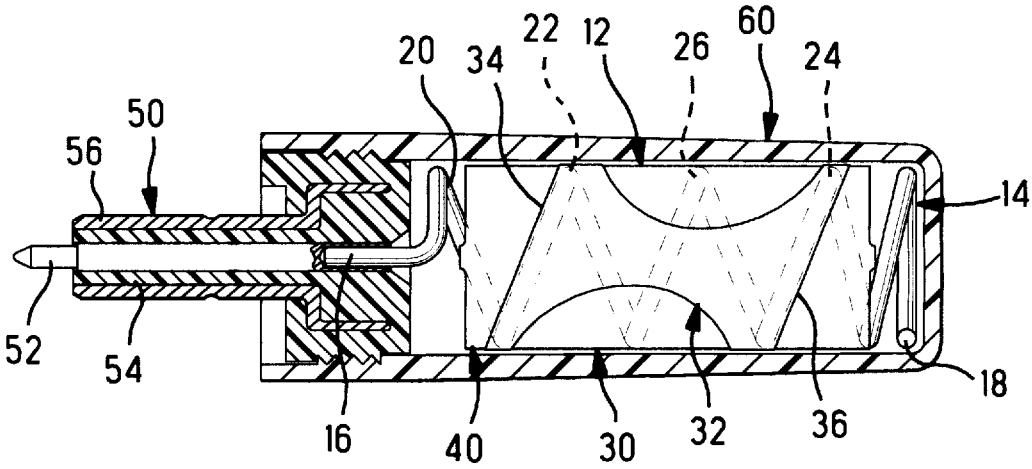
FIG. 2 is a cross-sectional view taken along line 2—2 of FIG. 1.
Figure 3:
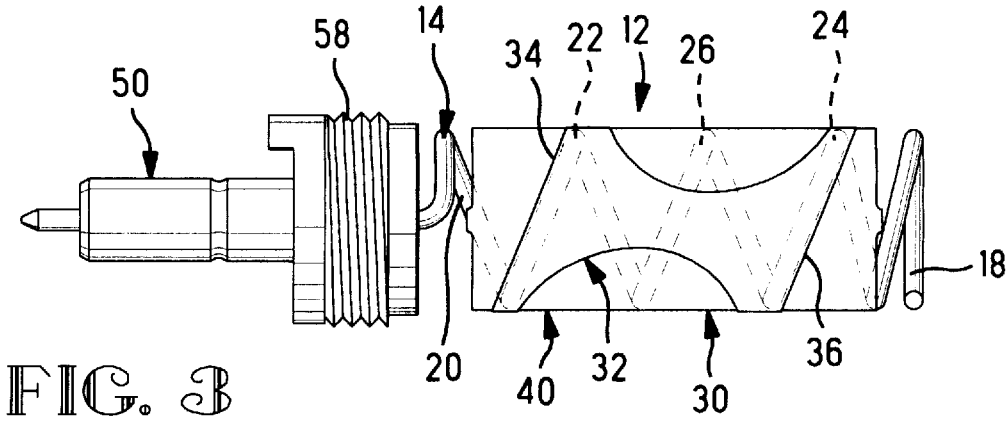
FIG. 3 is an assembled view of an antenna of FIG. 1 with the outer sheath removed.
Figure 5:
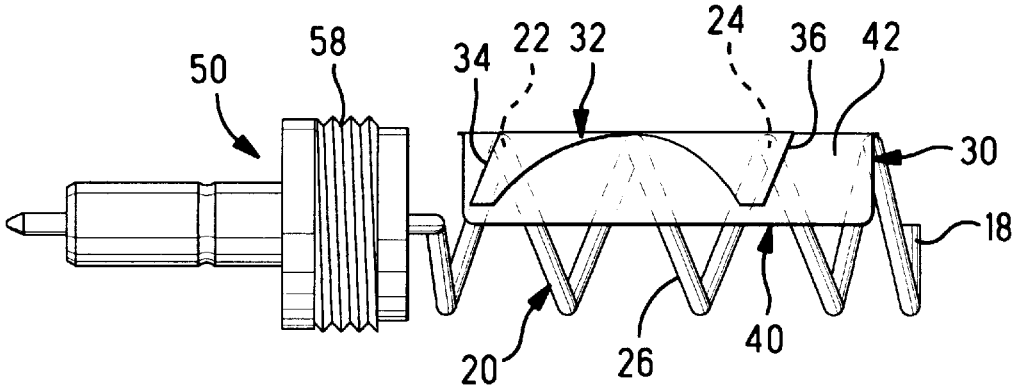
FIG. 5 is a view similar to that of FIG. 3, with the antenna rotated to show the position of the reactive element.

Antenna 12 includes a conductive first member 14 defining a coil and a second member 30 defining a reactive element. The coil 14 has first and second ends 16,18 and a plurality of windings 20 therebetween and including first and second selected windings 22,24, as best seen in FIGS. 2, 3, and 5. First end 16 is the feed point for the antenna and is adapted to be electrically connected to signal contact 52 of coaxial connector 50, as shown in FIG. 2. Coaxial connector 50 further includes an outer or ground contact 56 surrounding signal contact 52 and spaced therefrom by dielectric material 54, as known in the art. It is to be understood that other ways may be used to provide the reference potential for the antenna.

Figure 4:
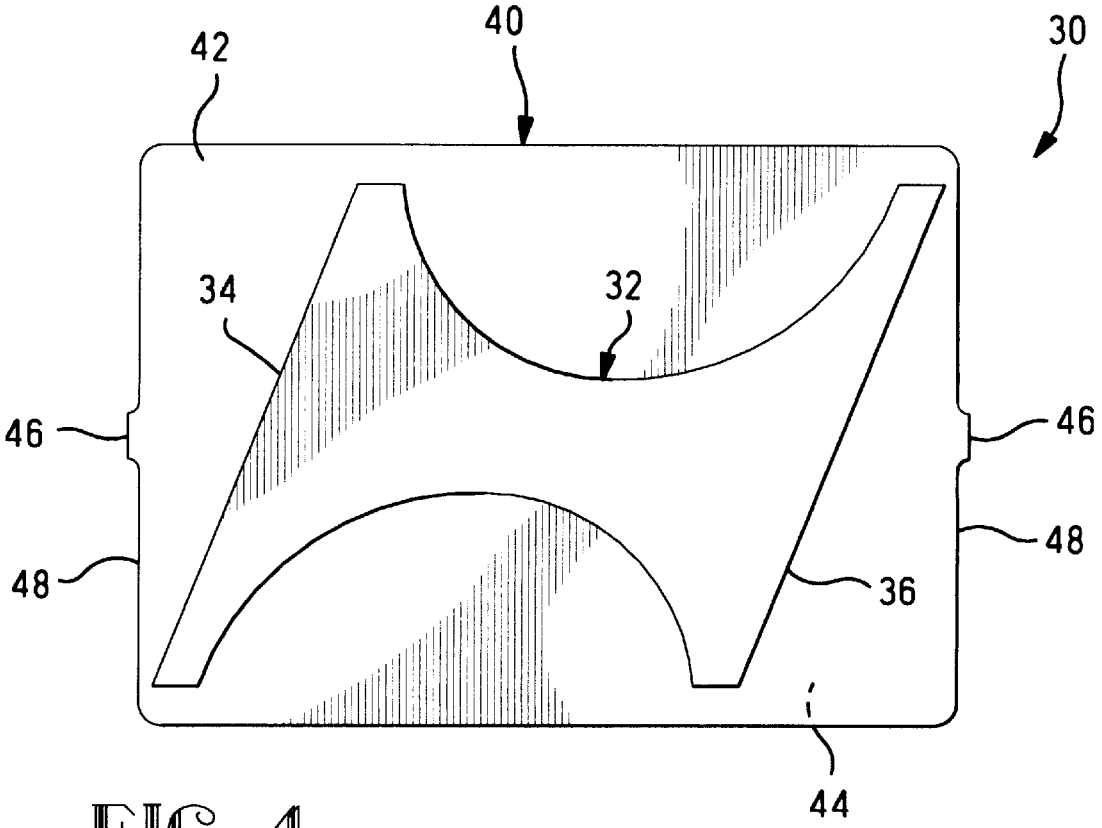
FIG. 4 is a plan view of the reactive element used in the antenna.

Reactive element 30 includes a conductive element 32 disposed on a first surface 42 of a dielectric film 40, as best seen in FIG. 4. The conductive element 32 has a selected area and shape and extends to first and second ends 34,36, associated with the first and second selected windings 22,24, respectively. To achieve maximum coupling between the conductive member 32 and the selected windings 22,24, it is desirable that the ends 34,36 of conductive member 32 are as wide as possible. It is also desirable that the coupling be minimized between the ends 34,36. It is to be understood that the shape of conductive member 32 is not limited to the one illustrated herein. Dielectric film 40 may further include outwardly directed protrusions 46 adjacent ends 48 thereof that may be used in positioning the reactive element 30 on the coil 14. Inwardly directed notches (not shown) or other features may also be incorporated in reactive element 30 to assure proper positioning.

The reactive element 30 is at least partially wrapped around the coil 14 with a second surface 44 of the film 40 adjacent to the windings 20 and extending therealong at least between the first and second selected windings 22,24 such that the first and second ends 34,36 of the conductive element 32 are adjacent to the first and second selected windings 22,24, as shown in FIGS. 2, 3 and 5. In the embodiment, as shown, the first and second ends 34,36 of the conductive element 32 are essentially aligned with the associated first and second selected windings 22,24, respectively and the dielectric film 40 extends only partially around the coil 14. As shown in these Figures, one or more additional windings 26 may be included between the first and second selected windings 22,24. It is to be understood that the dielectric member may be wrapped around the complete coil and that the ends of the conductive element do not need to be precisely aligned with the selected windings. The dielectric layer 40 extends between the conductive element 32 and the windings 20. The conductive element 32, dielectric layer 40 and windings 20 of coil 14 beneath layer 40 together define a capacitor.

The upper and lower frequencies of the dual band antenna 12 are defined by the dependent interaction between the coil 14 and the reactive element 32. At higher frequencies the admittance of the capacitor in effect shorts out some of the windings 20 of the coil 14. The admittance of the capacitor drops proportionally to the frequency making the overall length of coil 14 shorter, giving a match. Reactive element 30 is in effect a parasitic element. At lower frequencies, the admittance of the capacitor is too high to form the short circuit between the windings 20. The antenna 12, therefore, sees the full electrical length of the coil 14. At lower frequencies the reactive or parasitic element is essentially electrically inactive.

The antenna 12 can be tuned by adjusting the space between the windings of the coil 14, the length of the wire used in the coil 14 and the shape of the conductive member 32 in reactive element 30 including the number of windings 20 of the coil 14 covered by the reactive element 30, as well as its position transaxially on the coil 14.

The antenna 12 is assembled by disposing the reactive element 30 having the conductive element 32 on the film 40 over the desired portion of the coil 14. The high frequency band can be tuned by adjusting the location of the reactive element 30 on the coil 14. The film 40 is secured to coil 14 in the desired location by adhesive or other means, as known in the art, thereby forming antenna 12. The low frequency band of the assembled antenna 12 can then be tuned by trimming the second end 18 of coil 14. The first end 16 of the coil 14 is electrically connected to signal terminal 52 of coaxial connector 50 and the dielectric sleeve 60 is disposed over antenna 12 and secured to threads 58 of connector 50. Alternatively, sleeve 60 may be secured by adhesive or other methods, as known in the art.

Coil 14 may be made from suitable wires, such as phosphor bronze, steel, titanium, or the like, having sufficient spring temper. The conductive element 32 may be copper or other suitable material that is flexible enough to be formed around coil 14, or alternatively may be a printed conductive ink, as known in the art. The dielectric film may be made of Kapton, Mylar, or the like. Sleeve 60 can be made, for example, from polyurethane, polycarbonate, or similar materials, as known in the art.

Figure 6:
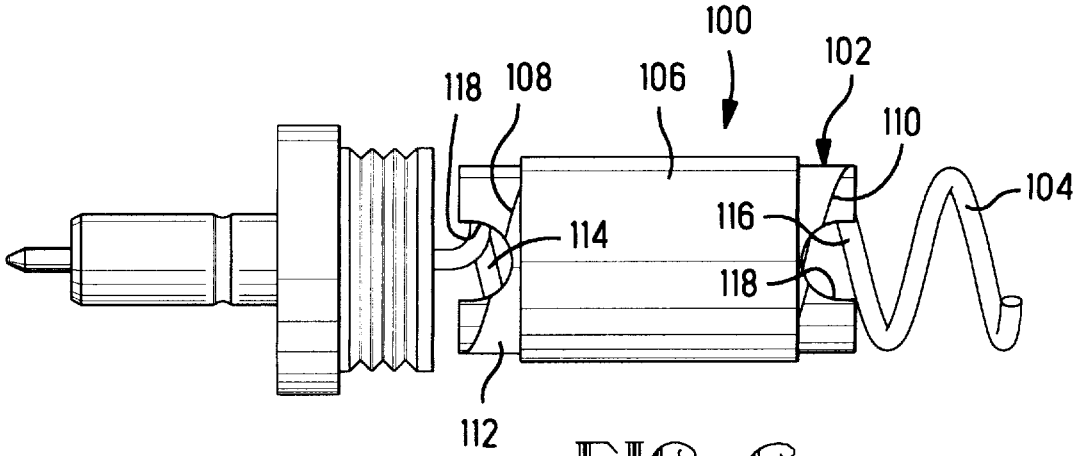
FIG. 6 is an assembled view of the antenna of FIG. 3 with a sleeve of heat shrink tubing utilized to secure the reactive element about the coil.

In antenna 100 of FIG. 6, the reactive element 102 is secured to the coil 104 by use of a length of heat shrink tubing 106, after it is positioned appropriately to align first and second ends 108,110 of conductive trace 112 with first and second windings 114,116. Heat shrink tubing may be made for example from polyolefin polymer as is commercially known and available, for example, from Raychem Corporation. The reactive element is shown as having notches 118 to assist in positioning.

Figure 7:
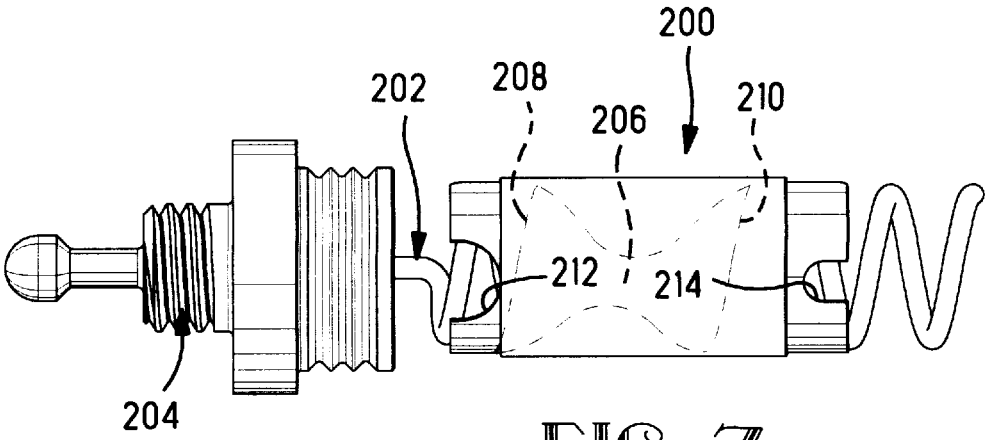
FIG. 7 is an assembled view similar to FIG. 6 with a non-coaxial connector.
Figure 8:
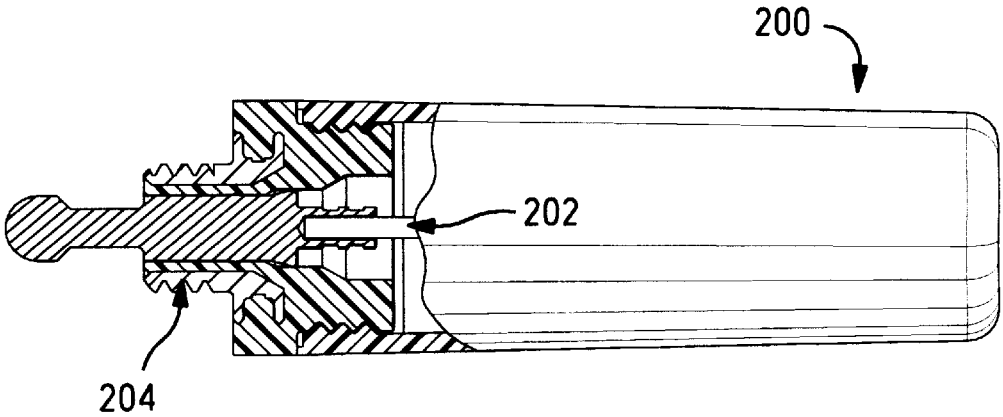
FIG. 8 is a part-cross-sectional view of the antenna of FIG. 7 with an outer sheath thereon.

Another embodiment of antenna assembly 200 is shown in FIGS. 7 and 8, one wherein antenna 202 has a non-coaxial electrical connector component 204. Such non-coaxial assemblies may be used such as in personal communication devices where shielding is accomplished by other means, and an outer conductor on the antenna itself is unnecessary. Such antennae may be smaller in size, more economical and easier to assemble. Conductive trace 206 is shown as having the first and second end sections 208,210 shortened axially while still extending sufficiently in the circumferential direction, to improve antenna performance when utilized with a coil having a smaller pitch (8/in) than the pitch (6/in) of the coil of the coaxial version of FIGS. 1 to 6. Further, notches 212,214 may be different to facilitate polarization.

The present invention provides a dual band antenna that has the capability to transceive at two different frequencies. It is compact, easily tunable and cost effective to manufacture. It is to be understood the antenna of the present invention is suitable for use with devices using other frequencies.

It is thought that the antenna of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. A dual band antenna comprising:

a first member defining a coil having a length between first and second ends and a plurality of windings including first and second selected windings between the first and second ends, said first end being a feed point; and a second member defining a reactive element, said second member including a conductive element disposed on a first surface of a dielectric film, said conductive element having a selected area and shape and extending to first and second ends associated with said first and second selected windings, said conductive element having a narrowed portion between its said first and second ends;

said second member being at least partially wrapped around said coil with a second surface of said film adjacent said windings and extending therealong at least between said first and second selected windings such that said first and second ends of said conductive element are adjacent said first and second selected windings with said dielectric layer between said conductive element and said windings;

whereby, at relatively high frequencies, said first and second ends of said second member capacitively couple with said first and second selected windings, but said narrowed portion does not capacitively couple with any of said windings, whereby said second member forms a short circuit between said first and second selected windings to effectively shorten the length of the coil.

2. The antenna as set forth in claim 1 wherein said feed point is electrically connected to a signal contact of a connector.

3. The antenna as set forth in claim 2 wherein a dielectric sleeve encloses said antenna and is affixed to said connector.

4. The antenna as set forth in claim 1 wherein said feed point is electrically connected to a signal contact of a coaxial connector.

5. The antenna as set forth in claim 4 wherein a dielectric sleeve encloses said antenna and is affixed to said coaxial connector.

6. The antenna as set forth in claim 1 wherein said first end of said conductive element is aligned with said first winding partially around said coil.

7. The antenna as set forth in claim 1 wherein said second end of said conductive element is aligned with said second winding partially around said coil.

8. The antenna as set forth in claim 1 wherein said second member includes protrusions from edges of said film for positioning said second member relative to said coil.

9. The antenna as set forth in claim 1 wherein said second member includes notches along edges of said film for positioning said second member relative to said coil.

10. The antenna as set forth in claim 9 wherein said notches are dissimilar for polarization.

11. The antenna as set forth in claim 1 wherein said first member is a wire of constant diameter.

12. The antenna as set forth in claim 11 wherein said first and second ends of said conductive element are each as wide as a diameter of said wire.

13. The antenna as set forth in claim 1 wherein second member is secured to said coil by adhesive material.

14. The antenna as set forth in claim 1 wherein said second member is secured to said coil by a length of heat shrink tubing.

* * * * *